US006121989A

United States Patent [19]

Song

[11] Patent Number: 6,121,989

[45] Date of Patent: Sep. 19, 2000

[54] TRANSPARENCY HAVING PRINTING SURFACE DISCRIMINATING AREA METHOD FOR DISCRIMINATING PRINTING SURFACE OF TRANSPARENCY IN THERMAL PRINTER AND DEVICE APPROPRIATE THEREFOR

[75] Inventor: Jun-pil Song, Suwon, Rep. of Korea

[73] Assignee: Samsung Electronics Co., Ltd., Kyungki-Do, Rep. of Korea

[21] Appl. No.: 08/856,980

[22] Filed: May 15, 1997

[30] Foreign Application Priority Data

May 15, 1996 [KR] Rep. of Korea ..... 96-16247

[51] Int. Cl.[7] ..... B41J 2/32; B41J 11/46

[52] U.S. Cl. ..... 347/218

[58] Field of Search ..... 347/171, 218; 400/703, 711, 712

[56] References Cited

U.S. PATENT DOCUMENTS

| | | | |
|---|---|---|---|
| 5,438,345 | 8/1995 | Hisaaki | 347/218 |
| 5,519,428 | 5/1996 | Van Peteghem | 347/218 |

FOREIGN PATENT DOCUMENTS

| | | |
|---|---|---|
| 63-82573 | 5/1988 | Japan . |
| 63-258344 | 10/1988 | Japan . |
| 2-227271 | 9/1990 | Japan . |
| 3-4239 | 1/1991 | Japan . |
| 3-131685 | 6/1991 | Japan . |
| 4-347671 | 12/1992 | Japan . |
| 5-104709 | 4/1993 | Japan . |
| 6-23950 | 3/1994 | Japan . |
| 6-87263 | 3/1994 | Japan . |
| 6-87284 | 3/1994 | Japan . |
| 8-106189 | 4/1996 | Japan . |

*Primary Examiner*—Huan Tran

*Attorney, Agent, or Firm*—Sughrue, Mion, Zinn, Macpeak & Seas, PLLC

[57] ABSTRACT

A transparency having a printing surface discriminating region includes an activating region for activating an optical sensor and a nonactivating region so that whether a printing paper is properly supplied can be detected by the sensor. Also, an apparatus for discriminating the printing surface of the transparency in a thermal printer includes a CPU for controlling a printing process by driving a thermal print head heat generator when the printing medium is paper and performing a printing surface discriminating process when the printing medium is a transparency, a stepping motor for transferring the printing medium in a predetermined step unit under the control of the CPU, a printing surface detecting sensor for detecting a region for discriminating the printing surface of the transparency under the control of the CPU, when the printing medium is a transparency, a comparator for receiving the output of the printing surface detecting sensor and outputting a digital signal to the CPU, and a memory for storing printing surface discriminating data which is output from the CPU. Therefore, when the transparency is improperly supplied, it is automatically discharged, so that damage to a thermal print head is prevented.

9 Claims, 4 Drawing Sheets

TRANSPARENCY HAVING PRINTING SURFACE DISCRIMINATING AREA METHOD FOR DISCRIMINATING PRINTING SURFACE OF TRANSPARENCY IN THERMAL PRINTER AND DEVICE APPROPRIATE THEREFOR

BACKGROUND OF THE INVENTION

The present invention relates to a thermal dye sublimation-type or wax-type printer system which transfers a printing paper using, a stepping motor and more particularly, to an overhead projector transparency (OHPP) (hereinafter, referred to as a "transparency") having a printing surface discriminating area formed thereon, a method for discriminating the printing, surface of the transparency in a thermal printer and an apparatus appropriate therefor, whereby, only when the transparency is loaded in a cassette tray and the printing surface is determined to be in a proper direction printing is performed.

A general thermal dye sublimation-type color printer stores image data transmitted from a device, such as a computer in a memory transmits the image data stored in the memory to a thermal print head (TPH), and records the transmitted image data on paper. That is, the sublimation-type thermal printer employing the thermal print head (TPH) sublimates ink on an ink ribbon by converting electric energy into thermal energy and represents the image data on the recording paper by adsorbing the sublimated ink thereon.

FIG. 1 is a block diagram showing the configuration of a conventional thermal printer. The conventional thermal printer includes a feeding motor 1 for supplying printing paper loaded in a printing paper cassette tray 6 to a capstan roller 7 and a pinch roller 8, a stepping motor 2 for transferring the printing paper supplied to the capstan roller 7 and the pinch roller 8 in stepwise form, a TPH heat generator 3 for representing image data on the printing paper by converting electric energy into thermal energy a discharging motor 4 for discharging the printing paper, and a CPU 5 for controlling a series of printing operations.

The operation of the thermal printer structured as shown in FIG. 1 will be described briefly as follows. When printing paper is loaded in the printing paper cassette tray 6 and a print command is input, a printing operation begins via a platen while the printing paper is supplied to a position where the capstan roller 7 is engaged with the pinch roller 8. At this time the CPU 5 determines what type of printing, medium (a general printing paper or a transparency) is being printed on using a sensor (not shown), and then sets a heat generating time per line according to respective input information and controls the operation of each block shown in FIG. 1 during the printing, operation.

In the conventional thermal printer, when the printing medium is supplied from the printing paper cassette tray 6, only the type of printing medium (a general printing paper or a transparency) is discriminated thereby performing a printing operation. Also, in the conventional thermal printer, the transparency undergoes a special chemical treatment so that dyes of an ink ribbon can be stably deposited on the printing surface of the transparency according to the heat generation of the thermal print head. Thus, when the heat generation thereof occurs on the transparency surface opposite the printing surface (hereinafter, referred to as an "opposite transparency surface"), the chemical characteristic of the dyes is not consistent with that of the opposite transparency surface, so the dyes of the ink ribbon are not properly deposited on the opposite transparency surface.

Thus, if the transparency is loaded in the printing paper cassette tray 6 so that the opposite transparency surface contacts the thermal print head, a proper image output cannot be obtained even though printing is normally completed, and the surfaces of the ink ribbon and the transparency may be severely damaged due to the heat generation of the thermal print head. Furthermore, the surface of the thermal print head is severely damaged, which causes deterioration of image quality.

SUMMARY OF THE INVENTION

To solve the above-described problems, it is an object of the present invention to provide a transparency having a printing surface discriminating area for use in a thermal printer employing an optical sensor.

It is another object of the present invention to provide a method for discriminating between the printing surface of the transparency and the opposite transparency surface in the thermal printer whereby, when the printing surface of the transparency is sensed and the transparency is supplied with the printing surface faced toward a printer head, printing is performed, and when the transparency is supplied with the opposite transparency surface facing the printer head, a self-diagnosis function is performed.

It is still another object of the present invention to provide an apparatus for discriminating between the printing surface of the transparency and the opposite transparency surface in the thermal printer, which performs a printing operation when the printing surface of the transparency is sensed and the transparency is supplied with the printing surface facing toward a printer head. and conducts a self-diagnosis function when the transparency is supplied with the opposite transparency surface facing the printer head.

To accomplish the first object, it is preferable that a transparency having a printing surface discriminating region comprises an activating region having a predetermined portion coated with a reflective material for reflecting an optical signal to activate an optical sensor, and a nonactivating, region for transmitting the optical signal therethrough not to activate the optical sensor.

To accomplish the second object, there is provided a method for discriminating the printing surface of a transparency in a thermal printer, comprising the steps of: a) supplying a printing medium to a position where a capstan roller and a pinch roller are engaged; b) determining the type of printing medium and performing a printing process when the supplied printing medium is paper; c) performing a process for discriminating the printing surface of the transparency when the supplied printing medium is a transparency; and d) performing a printing process when the printing surface of the transparency is properly supplied, and otherwise performing a self diagnosis function.

To accomplish the third object, there is provided a thermal printer having a function of detecting the printing surface of a transparency, comprising: a feeding motor for transferring a printing medium to the position where a capstan roller and a pinch roller are engaged; a thermal print head heat generator for receiving image data and reproducing the image on the printing medium; a discharging motor for discharging the printing medium; a CPU for controlling a printing process by driving the thermal print head heat generator when the printing medium is paper, and performing, a printing surface discriminating process when the printing medium is a transparency; a stepping, motor for transferring the printing medium in a predetermined step unit under the control of the CPU; a printing surface detecting sensor for detecting a region for discriminating the printing surface of the transparency under the control of the CPU, when the printing medium is a transparency; a comparator for receiving the output of the printing surface detecting sensor and outputting a digital signal to the CPU; and a memory for storing printing surface discriminating data which is output from the CPU.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
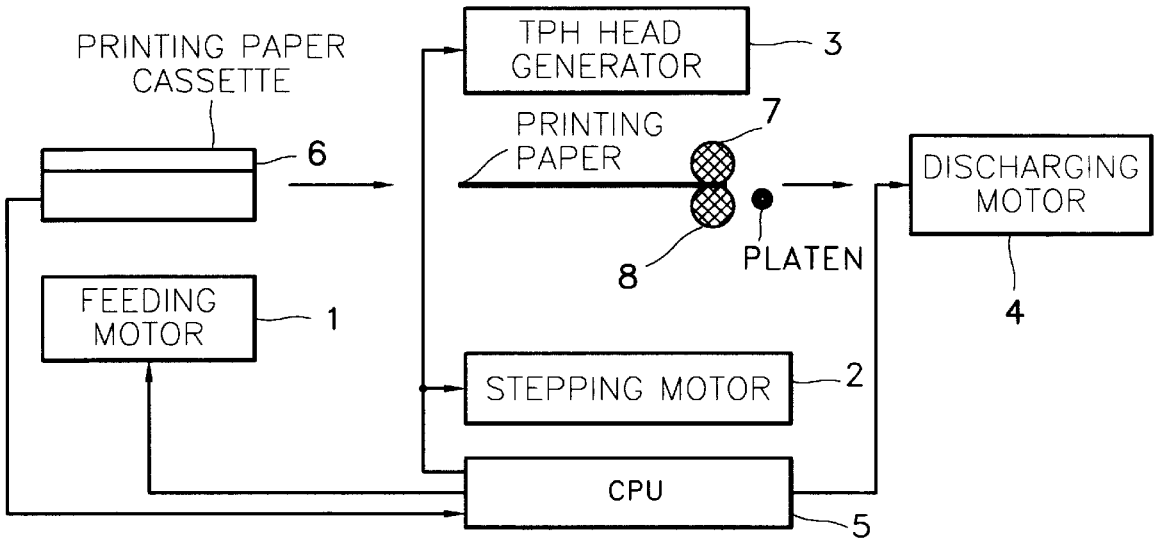
FIG. 1 (PRIOR ART)
FIG. 1 is a block diagram showing the configuration of a conventional thermal printer.
Figure 2A:
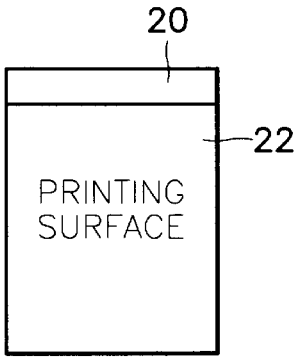
FIG. 2A (PRIOR ART)
FIGS. 2A and 2B show a conventional transparency and a transparency having a printing surface discriminating region according to the present invention, respectively.
Figure 2B:
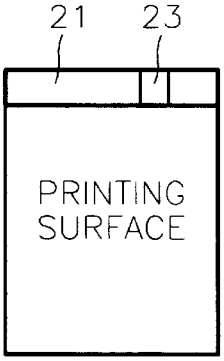

FIG. 2A shows a conventional transparency and FIG. 2B shows a transparency having a printing surface discriminating region according to the present invention. Referring to FIGS. 2A and 2B, first and second regions 20 and 21 activate an optical sensor (not shown), and third and fourth regions 22 and 23 do not activate the optical sensor. That is, a transparency having, a printing surface discriminating region includes an activating region coated with an optical signal reflecting matter as in the second region 21 so that light is reflected to activate the optical sensor, and a non-activating region for transmitting light therethrough as in the fourth region 23 so that the optical sensor is not activated.

Figure 3:
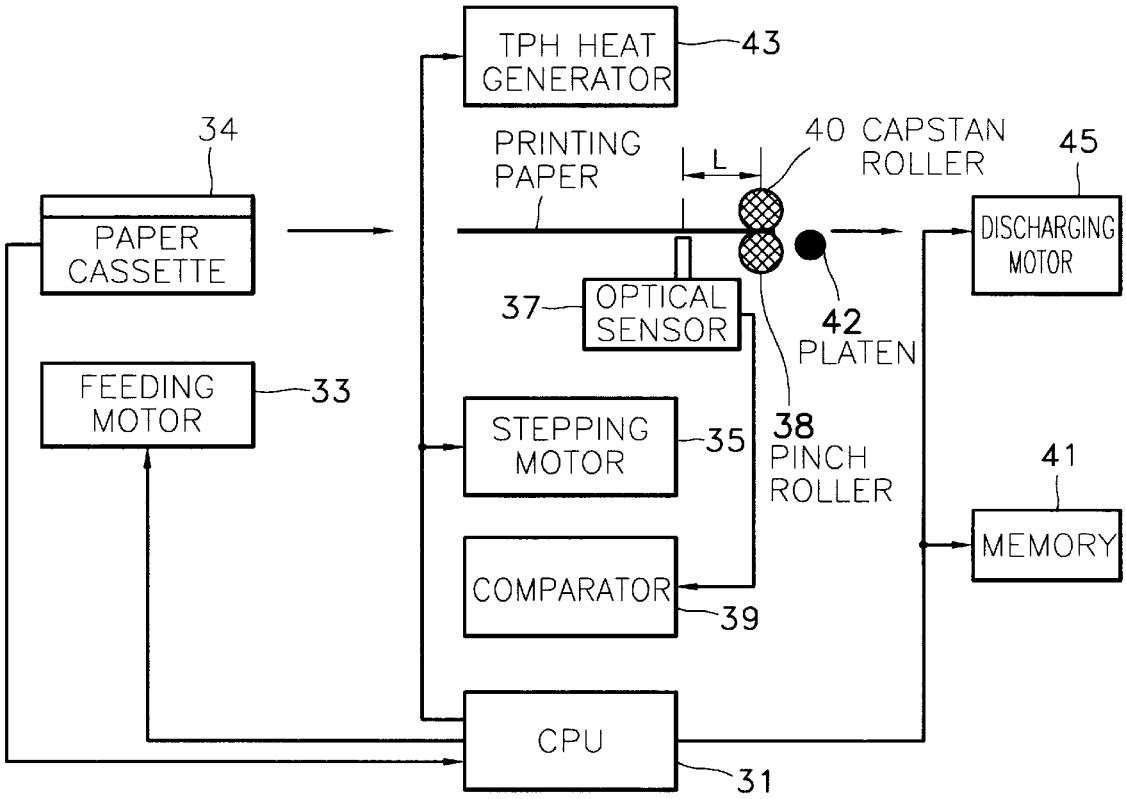
FIG. 3 is a block diagram showing the configuration of a thermal printer having a function of discriminating between the printing surface of a transparency and the opposite transparency surface, according to the present invention.

FIG. 3 is a block diagram showing the configuration of a thermal printer having a function of discriminating the printing surface of a transparency, according to the present invention. The thermal printer according to the present invention includes a central processing unit (CPU) 31 for controlling a printing process by driving a thermal print head heat generating portion 43 when the printing medium is a general paper and performing a printing surface discriminating process when the printing medium is a transparency a feeding motor 33 for transferring a printing paper to the position where a capstan roller 40 and a pinch roller 38 are interlocked, a stepping motor 35 for transferring the printing paper in a predetermined step unit under the control of the CPU 31, an optical sensor 37 for detecting a region for discriminating the printing surface of the transparency under the control of the CPU 31 when the printing paper is a transparency a comparator 39 for receiving the output of the optical sensor 37 and outputting a digital signal to the CPU 31, and a memory 41 for storing printing surface discriminating data (BIT OHP) output from the CPU 31. The thermal print head heat generating portion 43 receives image data and reproduces the image on the printing medium. A discharging motor 45 discharges the printing medium under the control of the CPU 31. A conventional sensor for detecting the type of paper can be used as the optical sensor 37.

FIGS. 4A through 4F show the states of the transparency being supplied to the thermal printer shown in FIG. 3, which has the function of discriminating the printing surface of the transparency. Reference letter 1 denotes a distance between the optical sensor 37 and the capstan roller 40, reference letter N designates a section where the optical sensor 37 scans the transparency, reference letter M represents a value which is obtained by subtracting the value of (L+N) from the entire length of the transparency and the optical sensor 37 detects a predetermined activating region 21.

Figure 5:
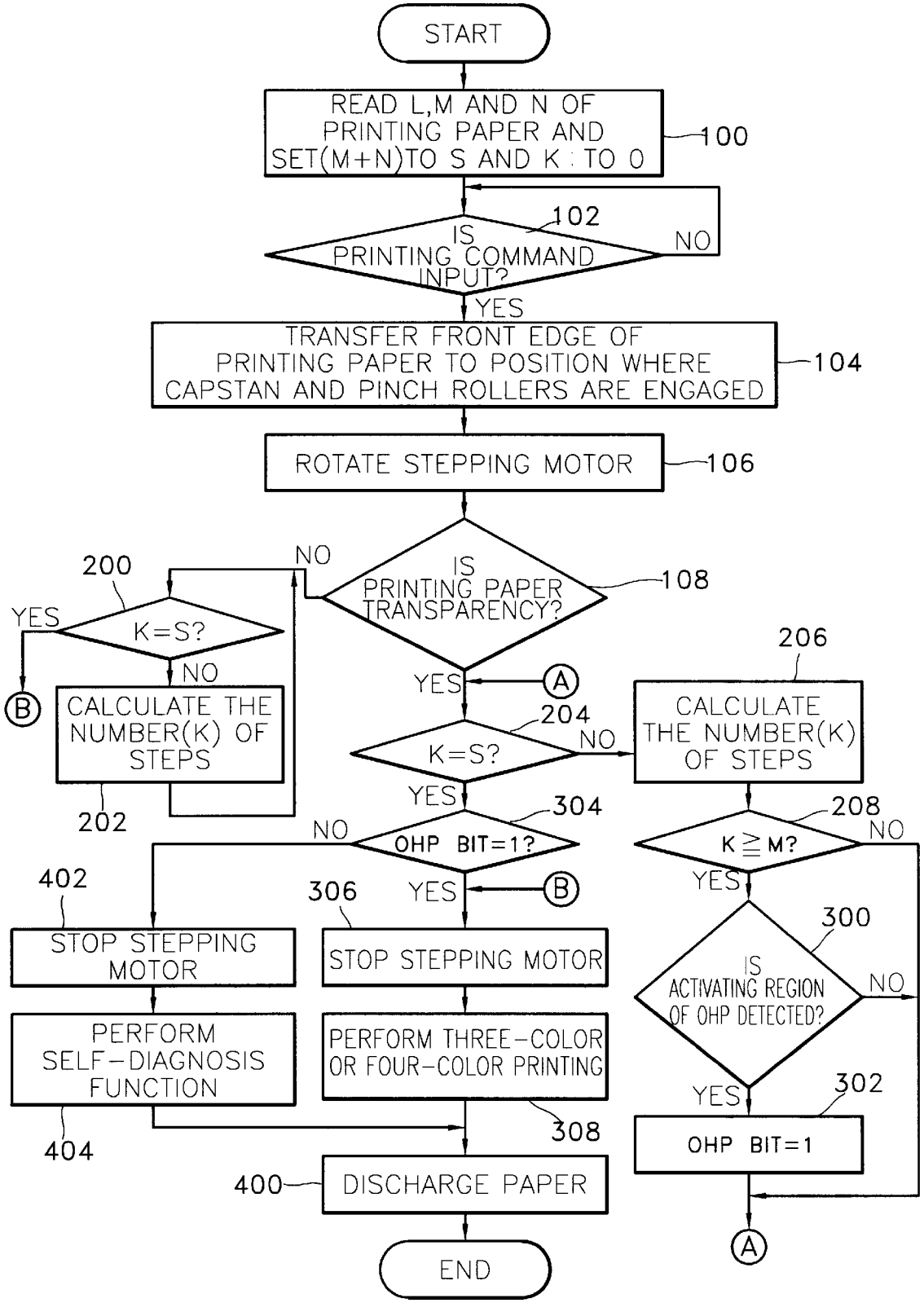
FIG. 5 is a flow chart outlining the operation of the thermal printer shown in FIG. 3.

FIG. 5 is a flow chart outlining the operation of the thermal printer shown in FIG. 3 which has the function of discriminating the printing surface of the transparency.

The present invention will now be described with reference to FIGS. 2B to 5 as follows.

When power is supplied to the printer, the CPU 31 stores the values of L, M and N which correspond to the length of the printing paper and sets a value (M+N) obtained by subtracting the value of L from the entire length of the printing paper to "S" and the number of rotations (K) of the stepping motor 35 to "0", in step 100.

When a print command is input in step 102, the printing medium in the printing paper cassette tray 34 is transferred by the driving force of the feeding motor 33 until the front edge thereof reaches a position where the capstan roller 40 and the pinch roller 38 are engaged, in step 104. At this time, the stepping motor 35 is at a pause, and the transferring operation is performed only by the feeding motor 33.

Figure 4A:
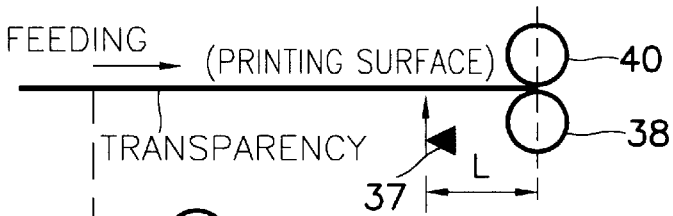
FIGS. 4A through 4F show the states of the transparency being supplied to the thermal printer having the function of discriminating between the printing surface of the transparency and the opposite transparency surface shown in FIG. 3.

FIG. 4A shows the state where the front edge of the transparency has reached the position where the capstan roller 40 and the pinch roller 38 are engaged. The printing medium is transferred in a predetermined step unit by driving the capstan roller 40 using the rotation force of the stepping motor 35 shown in FIG. 3, in step 106. Here, for the convenience of an explanation. assume that the unit of S is mm and the number (K) of steps of the stepping motor per 1 mm is "1".

After step 106, the optical sensor 37 determines whether the supplied printing medium is paper or transparency, in step 108. Then when the supplied printing medium is general print paper, the paper is transferred by S in steps 200 and 202 and a printing operation is then performed.

On the other hand, when the printing medium supplied in step 108 is a transparency, the stepping motor 35 is driven and the number K of steps is compared to S to determine if the former equals the latter. At this time, when the number K of steps is not equivalent to S, a printing surface discriminating operation is performed in steps 206 through 302. Thereafter, according to the result of the discrimination of the printing surface, a printing operation is performed in steps 306 through 400 or a self-diagnosis function is performed in steps 402, 404 and 400. That is, when a transparency is supplied, the CPU 31 transfers the transparency by S by driving the stepping motor 35, in steps 204 and 206. When the number K of steps is more than or equal to M in step 208, the optical sensor 37 determines the feeding direction of the transparency.

Figure 4B:
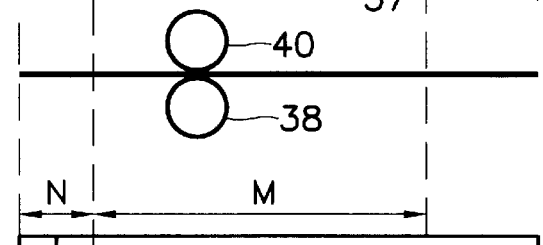

FIG. 4B shows the case that the number K of steps of the stepping motor 35 equals M. At this time, the length of from the optical sensor 37 to the end of the transparency remains as much as N, during which the optical sensor 37 senses a region for discriminating the printing surface of the transparency.

FIGS. 4C to 4F show the states of the transparency being supplied during the discrimination of the printing surface of the transparency, wherein reference letter P denotes the point when the optical sensor 37 starts detecting whether the transparency is properly supplied in the optical sensor detecting section (N).

Figure 4C:
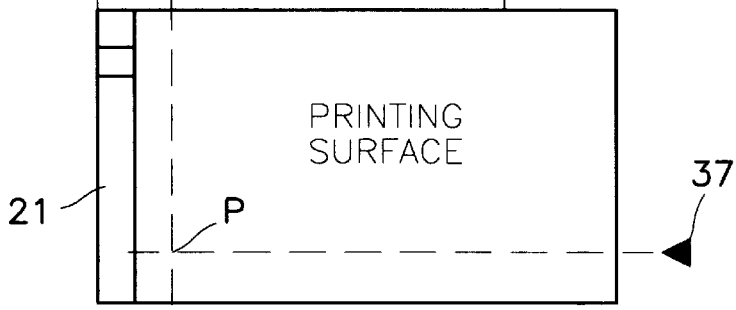
Figure 4D:
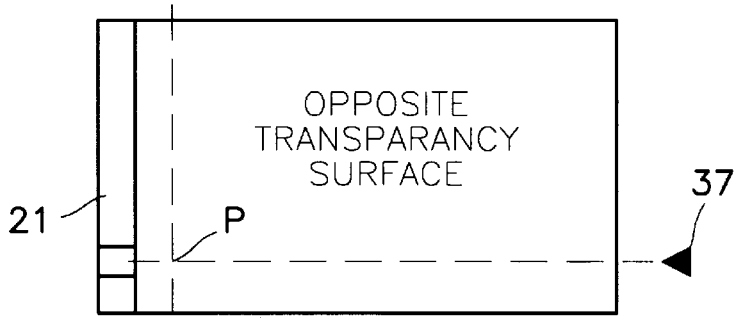
Figure 4E:
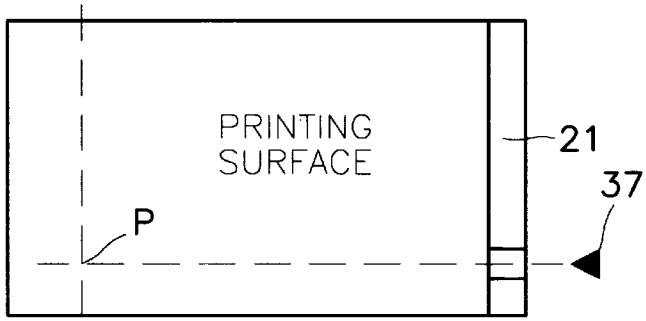
Figure 4F:
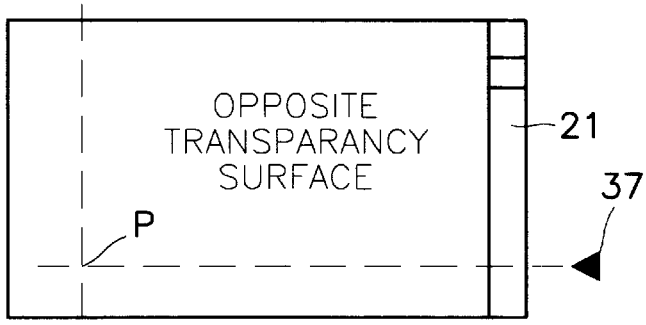

Since the activating region 21 of the transparency is detected in the section (N) only in FIG. 4C, the printing surface discrimination data (OHP BIT) is set to "1" only in the case of FIG. 4C.

When the optical sensor 37 detects the activating region 21 of the transparency shown in FIG. 2B, the OHP BIT is set to "1" in step 302. In other cases, the number of steps (K) of the stepping motor 35 is continuously counted in step 206. This job is repeated until the number of steps (K) of the stepping motor 35 becomes "S".

When the transparency is properly supplied in step 304, that is, when the OHP BIT is "1", the stepping motor 35 is stopped in step 306 and a three-color or four-color printing is performed in step 308. On the other hand, when the transparency is improperly supplied, the stepping motor 35 is paused in step 402, and a self diagnosis function is then performed to report that the transparency was improperly supplied in step 404. As the sell diagnosis function, a letter can be displayed or a beep sound can be generated.

As described above, in the method for discriminating the printing surface of the transparency in a thermal printer according to the present invention and the apparatus appropriate therefor, when the transparency is transferred from the printing paper cassette tray 34 with its printing surface placed as the opposite transparency surface, it is automatically discharged, thereby preventing damage to the ink ribbon and the transparency due to poor heat generation or over heating during printing. Furthermore operational errors do not occur by previously preventing damage to the thermal print head thereby heightening reliability of the product.

While only certain embodiments of the invention have been specifically described herein, it will apparent that numerous modifications may be made thereto without departing from the spirit and scope of the invention.

What is claimed is:

1. A method for discriminating a printing surface of a printing medium in a printer, said medium comprising at least a paper and a transparency, said transparency having at a trailing end thereof a printing surface discriminating region comprising a first region with a first detectable characteristic and a second region with a second detectable characteristic different from said first characteristic, said method comprising the steps of:

a) supplying said printing medium to a position where a capstan roller and a pinch roller are engaged;

b) determining the type of printing medium;

c) performing a printing process when said printing is paper;

d) performing a process for discriminating the printing surface when said printing medium is a transparency said discriminating process comprising advancing said print medium a predetermined distance, to a location proximate said trailing end, and thereafter detecting whether or not a first characteristic is present;

e) performing a printing process when the printing surface of said transparency is properly supplied as indicated by the presence of said first characteristic by said discriminating process, and f) performing a self diagnosis function when the printing surface of said transparency is not properly supplied.

2. The method as claimed in claim 1, wherein said step d) comprises the steps of:

transferring said transparency for discriminating the printing surface thereof to a printing surface detecting sensor by driving a stepping motor; and determining whether the printing surface of said transparency is supplied in the proper position by detecting the reflectance of said printing surface discriminating region, on said transparency, for discriminating the printing surface of said transparency.

3. A printer for printing image data on a printing medium, including a paper and a transparency, said transparency having at a trailing edge thereof a printing surface discriminating region comprising a first region with a first detectable characteristic and a second region with a second detectable characteristic different from said first characteristic, comprising:

a print head for receiving said image data and reproducing said image data on said printing medium;

a CPU for controlling a printing process by driving said print head when said printing medium is paper, and for performing a printing surface discriminating process when said printing medium is a transparency, said discriminating process comprising advancing said print medium a predetermined distance and, thereafter, determining whether or not said first characteristic is present and controlling the printing on said transmission medium when the printing surface of said transparency is properly supplied as indicated by the presence of said first characteristic by said discriminating process;

a printing surface detecting sensor for detecting the presence or absence of said first characteristic on said printing surface discriminating region, on said transparency, for discriminating the printing surface of said transparency under control of said CPU;

a comparator for receiving an output of said printing surface detecting sensor and outputting a digital signal to said CPU; and a memory for storing printing surface discriminating data output from said CPU.

4. The printer as claimed in claim 3, further comprising:

a feeding motor for transferring said printing medium to a position where a capstan roller and a pinch roller are engaged;

a discharging motor for discharging said printing medium; and a stepping motor for transferring said printing medium in a predetermined step unit under the control of said CPU.

5. The printer as claimed in claim 3, wherein said CPU receives said digital signal from said comparator and determines said region for discriminating the printing surface of said transparency.

6. The printer as claimed in claim 3, wherein said printing surface detecting sensor is an optical sensor for sensing a reflected light from said printing surface discriminating region.

7. The printer having a function of detecting the printing surface of a transparency as claimed in claim 5, wherein said CPU generates at least one of one a display of a letter and a beep sound to report that the feeding position of said transparency is wrong, when said transparency is improperly supplied.

8. The method as recited in claim 1 wherein said printer is a thermal printer.

9. The printer as recited in claim 4, wherein said print head comprises a heat generator and said heat generator is operated in response to said image data.

* * * * *